United States Patent [19]

Cowdrick

[11] 3,984,938

[45] Oct. 12, 1976

[54] SKY DIVER TOY

[75] Inventor: Arthur Cowdrick, Spring Lake Heights, N.J.

[73] Assignee: The Raymond Lee Organization, Inc., New York, N.Y. ; a part interest

[22] Filed: Aug. 7, 1975

[21] Appl. No.: 602,593

[52] U.S. Cl. ..... 46/86 R
[51] Int. Cl.[2] ..... A63H 33/20
[58] Field of Search ..... 46/74 R, 86, 87

[56] References Cited

UNITED STATES PATENTS

| | | | |
|---|---|---|---|
| 2,321,904 | 6/1943 | Frazier | 46/86 R |
| 3,041,779 | 7/1962 | Carter et al. | 46/86 R |
| 3,088,701 | 5/1963 | Fricke | 46/86 R |

*Primary Examiner*—Louis G. Mancene
*Assistant Examiner*—Robert F. Cutting
*Attorney, Agent, or Firm*—Daniel Jay Tick

[57] ABSTRACT

A releasable coupling device affixes a balloon inflated with helium to a miniature figure of a sky diver. The coupling device has a release cord extending therefrom to ground whereby the balloon raises the figure to a selected height and is released therefrom via the cord. A parachute is affixed to the figure whereby when the balloon is released from the figure, the figure descends via the parachute.

2 Claims, 5 Drawing Figures

SKY DIVER TOY

DESCRIPTION OF THE INVENTION

The present invention relates to a sky diver toy.

Objects of the invention are to provide a sky diver toy of simple structure, which is inexpensive in manufacure, used with facility and convenience, and provides amusement and interest to participants and onlookers alike.

In order that the invention may be readily carried into effect, it will now be described with reference to the accompanying drawing, wherein FIG. 1 is a front view of an embodiment of the sky diver toy of the invention;

Figure 1:
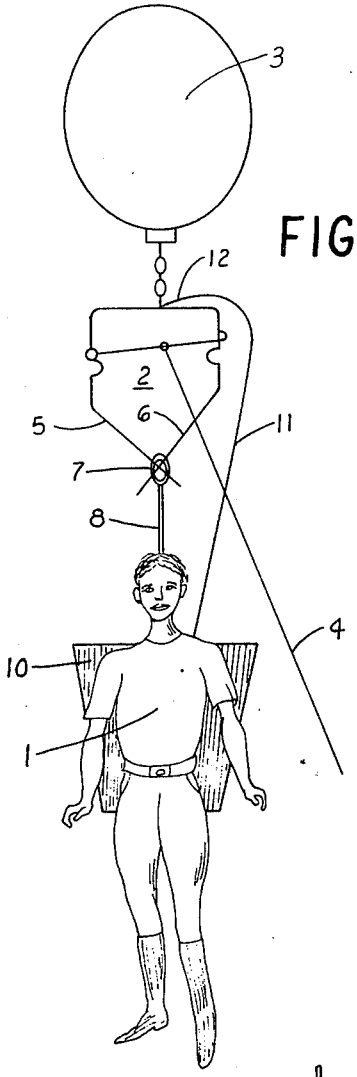
Figure 2:
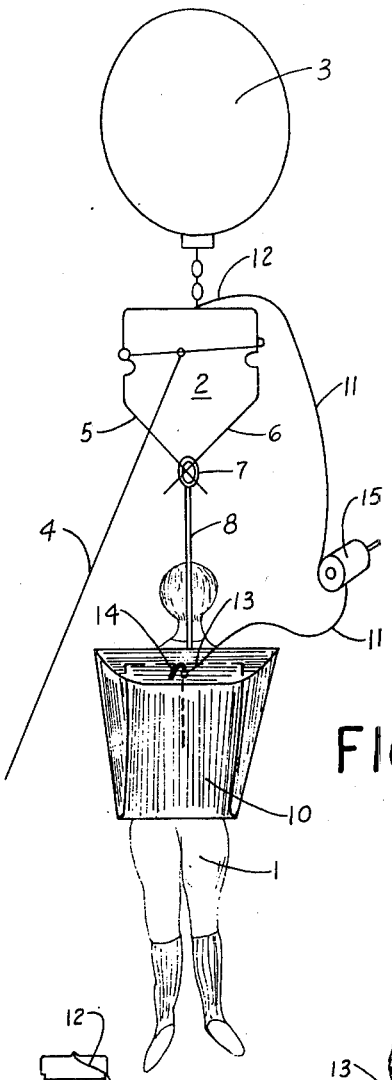
FIG. 2 is a rear view of the embodiment of FIG. 1.
Figure 3:
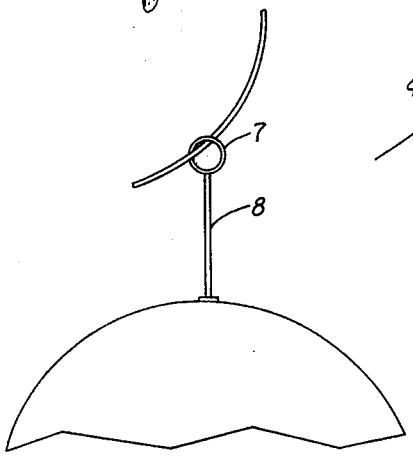
FIG. 3 is a view, on an enlarged scale, of part of the embodiment of FIG. 1.
Figure 5:
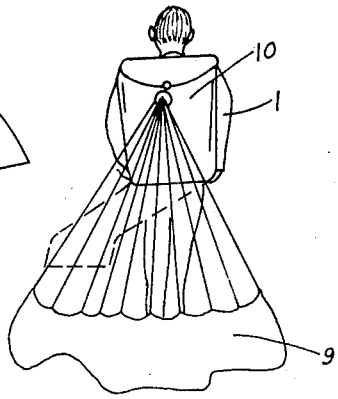
FIG. 5 is a view of the embodiment of FIG. 1 after the release of the balloon.

The sky diver toy of the invention comprises a miniature figure 1 of a sky diver (FIGS. 1, 2 and 5).

A releasable coupling device, generally indicated by reference numeral 2, as shown in FIGS. 1, 2 and 5, affixes a balloon 3 (FIGS. 1 and 2) to the figure 1. The releasable coupling device may comprise any suitable device for coupling the balloon 3 to the figure 1 until a cord 4 (FIGS. 1, 2 and 5) which extends from the coupling device to ground, is pulled, from the ground. When the cord 4 is pulled, it pulls a pair of flexible arms such as, for example, wire arms 5 and 6 out of a loop 7 to a wire-type extension 8 from the figure 1.

Each of the flexible wire arms 5 and 6 has an indentation formed therein. A cross arm of flexible wire has a closed loop formed at one end thereof extending around the arm 5 in the indentation of said arm. The cross arm has an open hook formed at its spaced opposite end slidably resting on the arm 6 in the area just above the indentation formed therein.

The arms 5 and 6, as shown in FIGS. 1, 2 and 5, are formed from a single length of resilient or spring-like wire, and have an inherent force urging them away from each other. The cross arm holds the arsm 5 and 6 together, against their inherent separating force, as shown in FIGS. 1 and 2, so that they cross over each other at their lowermost or free ends and support the loop 7.

When the cord 4 is pulled, it moves the cross arm pivotally about its loop on the arm 5 so that its hook slides downward along the arm 6 into the indentation formed in said arm. This releases the inherent separating force in the wire and permits the arms 5 and 6 to move apart, as shown in FIG. 5, thereby releasing the loop 7 and the figure 1 to which it is affixed.

The balloon 3 raises the figure 1 to a selected height desired by the user, and determined by the length of cord 4. When the figure 1 has reached the desired height, the user releases the balloon 3 therefrom by pulling on the cord 4.

A parachute 9 (FIG. 5) is provided in a pack 10 (FIGS. 1, 2, 4 and 5) affixed to the figure 1. When the balloon 3 is released from the figure 1, said figure descends via the parachute. This is accomplished by a parachute release control device coupled between the coupling device 2 and the parachute 9. The parachute release control device releases the parachute 9 from the pack 10 a predetermined time after the balloon 3 is released from the figure 1.

The release of the parachute is accomplished by a wire or cord 11 (FIGS. 1, 2, 4 and 5) which is affixed at its upper end 12 to the coupling device 2 and is affixed at its lower end 13 to a pin 14 (FIGS. 2, 4 and 5) which opens the pack 10 when it is pulled upward. Thus, when the balloon 3 floats free, it pulls the pin 14 out of the pack 10 via the wire or cord 11 and opens said pack to release the parachute 9, as shown in FIG. 5.

Figure 4:
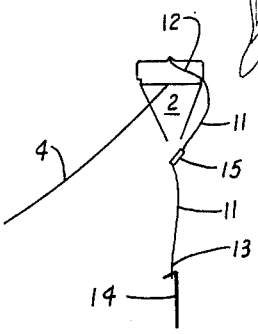
FIG. 4 is a view of the parachute pack of the sky diver toy of the invention.
Figure 4:
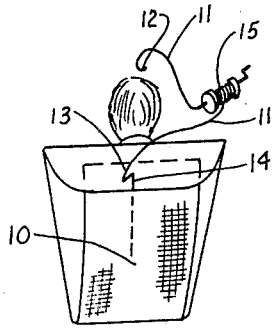

The time, after the release of the balloon 3 from the figure 1, at which the parachute pack 10 is opened and the parachute 9 is released, is determined by a spool 15 (FIGS. 2, 4 and 5). The cord or wire 11 is selected at any desired length and wound around the spool 15, although its ends are affixed to the coupling device 2 and the figure 1, respectively. Thus, when the balloon 3 is released from the figure 1, the entire cord 11 unwinds from the spool 15 before it exerts an upward pull at its end 13 affixed to the pin 14, thereby opening the pack 10 to release the parachute.

While the invention has been described by means of a specific example and in a specific embodiment, I do not wish to be limited thereto, for obvious modifications will occur to those skilled in the art without departing from the spirit and scope of the invention.

I claim:

1. a sky diver toy, comprising
   - a miniature figure of a sky diver;
   - A balloon inflated with helium;
   - a releasable coupling device affixing the balloon to the figure and having a release cord extending therefrom to ground whereby the balloon raises the figure to a selected height and is released therefrom via said cord;
   - a parachute affixed to the figure whereby when the balloon is released from the figure the figure descends via the parachute, said parachute having a release device; and
   - a parachute release control device coupled between the coupling device and the parachute for releasing the parachute a predetermined time after the balloon is released from the figure, said parachute release control device comprising a spool and a length of cord wound on the spool and having one end affixed to the parachute release device and another end affixed to the coupling device in a manner whereby when the cord is unwound from the spool said cord operates the parachute release device.

2. A sky diver toy, as claimed in claim 1, wherein the releasable coupling device comprises a resilient wire coupled to the balloon and having spaced opposite end sections bent in the wire and forming a pair of flexible wire arms, each having an indentation therein and an inherent force urging it away from the other, said arms crossing over each other at their free ends and supporting the figure at their cross over point, a cross arm of flexible wire having spaced opposite ends, said cross arm being substantially pivotally affixed to one of the wire arms at one of the ends of said cross arm and having a hook formed therein at the other of its ends slidably resting on the other of the wire arms in the area just above the indentation formed therein whereby when the release cord is pulled it moves the hook of the cross arm down into the identation formed in the wire arm on which it is resting thereby releasing the inherent separating force in the wire and permitting the wire arms to move apart to release the figure.

* * * * *